United States Patent [19]

Frentzel

[11] 4,115,898

[45] Sep. 26, 1978

[54] SUPPORT DEVICE FOR VERTICAL SLATS OF A SLATTED BLIND

[75] Inventor: Kurt Heinz Frentzel, Zevenhoven, Netherlands

[73] Assignee: Hunter Douglas International N.V., Willemstad, Netherlands Antilles

[21] Appl. No.: 782,314

[22] Filed: Mar. 29, 1977

[30] Foreign Application Priority Data

Mar. 31, 1976 [DE] Fed. Rep. of Germany ..... 2613751

[51] Int. Cl.[2] ..... E05D 13/02

[52] U.S. Cl. ..... 16/87 R; 160/196 D

[58] Field of Search ..... 16/87 R, 87.4 R, 87.2; 160/178 R, 199, 206, 196 D, 173, 183

[56] References Cited

U.S. PATENT DOCUMENTS

| | | | |
|---|---|---|---|
| 2,994,371 | 8/1961 | Morseth et al. | 160/183 X |
| 3,277,952 | 10/1966 | Tsuhako | 160/199 |
| 3,419,063 | 12/1968 | Mock et al. | 160/206 X |
| 3,516,473 | 6/1970 | Rosenquist | 160/199 X |

*Primary Examiner*—Dorsey Newton

*Attorney, Agent, or Firm*—Pennie & Edmonds

[57] ABSTRACT

The invention relates to a device for attaching the vertical slats of a slatted blind to another element for support, in which an end of each slat is inserted into a cap like member having inwardly directed suspension lugs which support the slat by engagement in holes through the slat which are spaced from but adjacent to the end edge of the slat.

3 Claims, 4 Drawing Figures

FIG. 1
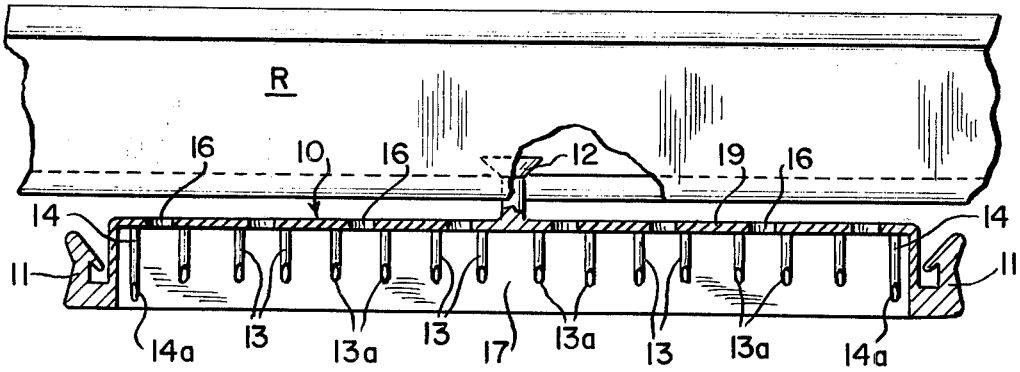
FIG. 2
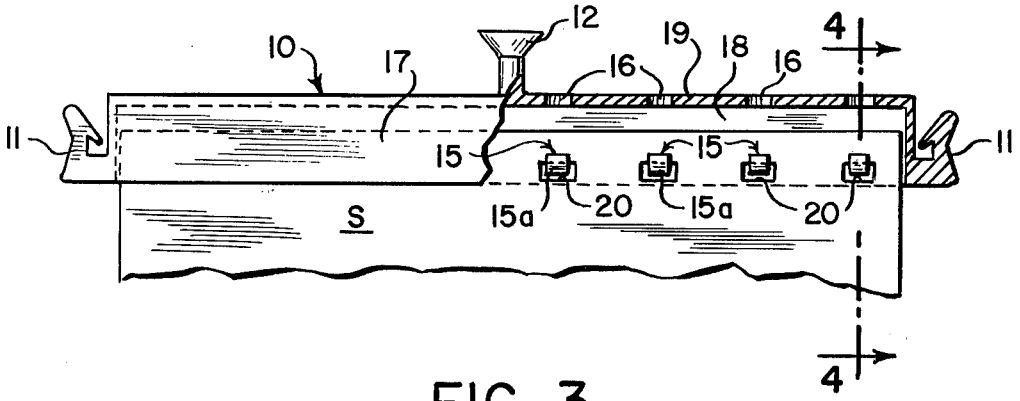
FIG. 3
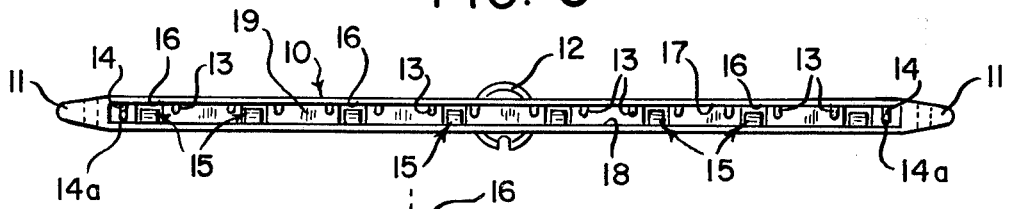
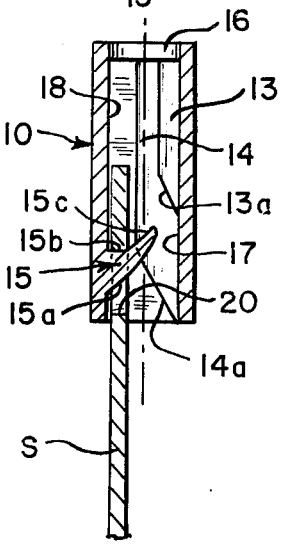
FIG. 4

SUPPORT DEVICE FOR VERTICAL SLATS OF A SLATTED BLIND

PRIOR ART

A previously known method of attaching the slats of a vertically slatted blind to a top rail employed a plurality of individual means distributed over the width of the slat and hooked or clipped to the end of the slat in suitable manner. The installation of these individual means is comparatively troublesome and time consuming, especially owing to the large number required. Another disadvantage is that either each outermost means must be provided with an attachment fitting as a purchase for the flexible connecting members required to connect neighboring slats, or these means must be differently constructed for the purpose and available as distinct parts.

BRIEF DESCRIPTION OF THE INVENTION

With this starting point, the object of the invention is to provide an attachment means for vertical slats which means is simple to manufacture and capable of rapid and problem-free assembly.

To accomplish this object, it is proposed according to the invention that the means take the form of a cap accepting one end of a slat, that the cap be provided on one inner side with a plurality of suspension lugs cooperating with apertures adjacent the slat end inserted in the cap, that the inner side of the cap opposed to the lugs be provided with contact ribs between the contact surfaces of the lugs and the top of the cap, and that the ends of the cap be provided on the outside with open or closed attachment fittings for connecting members.

The proposed device is suitable for combination with an upper as well as a lower end of a slat. Where reference is made anywhere herein only to the combination of the upper end of a slat with the proposed cap, this is merely to simplify the description, with no limitation on the actual field of application or scope of protection. When used at the top of a slat the cap may have means for engagement in a rail or other support element. When used at the bottom of a slat the cap may have means engaging a lower rail or the cap may have enough weight such that, alone or in combination with another element, the cap insures proper vertical disposition of the slat.

The slat end, then, may be inserted in such a cap in a single brief operation. As soon as the edge of the slat has passed the suspension lugs, the contact ribs opposite thereto become operative and press the slat towards the side having the suspension lugs, slightly bending the slat, which is made of a resilient material. As soon as the suspension lugs have fully engaged the openings in the slat, the edge of each opening towards the end of the slat slips over its associated lug, whereupon the face of the lug that faces toward the top of the cap engages the upper edge of the slot opening thus supporting the same.

Thus the insertion of the slat end is simple because the cap at first offers a comparatively wide gap up to the lugs, and the edge of the slat is deflected only from the lugs onward. Since the slat, due to its resiliency, tends to remain as far as possible in one plane, the contact ribs extending closer to the top of the cap than the support surfaces of the lugs can safely keep the slat from slipping off the support surfaces on the lugs.

According to another feature of the invention, each outermost contact rib, nearest one of the length-wise edges of the slat, may extend somewhat beyond the support surfaces of the lugs towards the cap opening, since it is primarily in this outer region that the slat may possibly be stressed in such a way as perhaps to lift off the outer suspension lugs.

It is further advantageous if the contact ribs and/or the lugs exhibit bevels at their ends towards the cap opening side, merging with the associated inner side of the cap. Such bevels will guide the slat end properly inside the cap.

It is desirable also for the top of the cap to be provided with openings, each aligned with a suspension lug. By virtue of such alignment of suspension lugs and openings, a suitable tool may be inserted through the openings into the interior of the cap when the slat is to be detached from the cap, the slat being lifted up and off the lugs without difficulty by means of the tool.

It is proposed further that the suspension lugs be slightly inclined at their free ends towards the top of the cap. Such an inclination leading into the interior of the cap displaces the region of contact of the slat with the lugs as far as possible towards that inner side of the cap from which the lugs extend.

BRIEF DESCRIPTION OF THE DRAWINGS

The invention will be understood by those skilled in the art from the following description and drawings in which:

FIG. 1 shows a longitudinal section of the device;

FIG. 2 shows an elevational view of the device in partial longitudinal section, taken from the direction opposite to that of the view in FIG. 1;

FIG. 3 shows a bottom view of the device;

FIG. 4 shows a cross section of the device.

DETAILED DESCRIPTION OF THE INVENTION

The device is in the form of an elongated cap 10, its length dimensioned to receive the width of a slat S.

At the two ends of the cap 10, hook-like fittings 11 are formed on the outside by which the cap 10 may be connected to the caps of neighboring slats by means of a cord, chain or the like. The cap 10 is suspended by means of a head 12 from a top rail R, supporting and guiding the several slats of the blind although other shapes for head 12 are contemplated as well as other well known mechanisms for engagement in top rail R. It is also to be understood that cap 10 may be suspended from known structures other than the rail R. It is further to be understood that cap 10 may be used at the bottom of a slat where the head 12 or like mechanism may or may not be required depending upon the construction of the blind.

As seen in FIG. 1, the visible inner side 17 of the cap 10 is provided with contact ribs 13 running parallel to each other from the top downward. The ribs 13 have bevels **13*a* at the bottom merging with the inner side 17 of the cap 10. The two outermost ribs 14, likewise having bevels 14*a* at the bottom, extend farther down than the ribs 13**.

FIG. 2 shows the arrangement of suspension lugs 15 on the opposite side 18 of the cap 10. Above each lug 15, an opening 16 is provided in the top 19 of the cap 10.

The shape of the lugs 15 is shown further in FIG. 4. The lugs 15 too have bevels **15*a* at the bottom, merging with the corresponding inner side 18 of the cap 10. The tops 15***b* of the lugs 15 serve as contact surfaces for the top edges of openings 20 in the slat S, said tops 15*b* being slightly oblique upward in the outer portion 15*c* so as to help keep the slat from slipping off the tops of the lugs 15.

FIG. 4 further shows that the ribs 13 lie above the lugs 15, while the outer ribs 14 are longer and extend into the region below the nearby lugs 15. Also, the ribs 14 are somewhat deeper than the ribs 13, as may be seen in FIG. 4, so that they extend somewhat beyond the center of the gap formed between the inner sides 17, 18 of the cap 10. The ribs 13 and 14 and the lugs 15 are so distributed along the length of the cap 10, that there is always a rib 13 or 14 provided comparatively close to a lug 15 on both sides thereof, as shown in FIG. 3.

When the top of a slat is inserted into the cap 10, its edge can advance virtually unimpeded as far as the region between the bevels 13*a*, 14*a* and the lugs 15. Then the bevels 13*a*, 14*a* bend or deflect the slat towards the lugs 15. As soon as the slat has been advanced far enough so that its openings 20 are on a level with the lugs 15, the slat will engage the lugs 15 of its own accord because of its resiliency. The ribs 13 and 14 prevent the slat from becoming disengaged from the suspension lugs 15 under normal use.

When it is desired to remove a cap 10 from a slat, a tool is inserted through the opening 16, by means of which the slat is deliberately lifted up and pushed off the lugs 15.

I claim:

1. A device for attaching a slat to a support of a slatted blind comprising an elongated cap; said cap having a pair of spaced substantially parallel side walls, a transverse wall extending between said side walls along their length, and and end wall extending between said side walls at each end thereof; said cap having an open side opposite to said transverse wall; a plurality of support lugs extending from one side wall toward the other side wall for engagement in openings adjacent an end of a slat; at least three ribs extending from the other of said side walls toward said one side wall; said ribs being so dimensioned as to permit deliberate disengagement of a slat from said lugs while insuring maintenance of such engagement under normal use conditions, said ribs being elongated in a direction transverse to the length of said cap, said lugs and said ribs having a sloped surface generally facing the open side of said cap, at least one opening through said transverse wall for insertion of a tool to disengage a slat from said lugs, and the rib adjacent each end of said other wall extending to closer to the open side of said cap than ribs between said end ribs

2. The article of claim 1 in which said end ribs extend to closer to said one wall than ribs therebetween.

3. The article of claim 2 in which the end walls of said cap have means for attachment to like means on neighboring caps.

* * * * *